United States Patent [19]

Parker

[11] 4,012,160

[45] * Mar. 15, 1977

[54] PAVING MACHINE WITH ENCLOSED MATERIAL COMPARTMENT

[76] Inventor: Jimmy L. Parker, 19909 Filbert Drive, Bothell, Wash. 98011

[ * ] Notice: The portion of the term of this patent subsequent to July 6, 1993, has been disclaimed.

[22] Filed: Apr. 19, 1976

[21] Appl. No.: 678,146

Related U.S. Application Data

[63] Continuation-in-part of Ser. No. 452,056, March 18, 1974, Pat. No. 3,967,912.

[52] U.S. Cl. ..... 404/84

[51] Int. Cl.[2] ..... E01C 19/00

[58] Field of Search ..... 404/84, 101, 106, 83, 404/108, 118

[56] References Cited

UNITED STATES PATENTS

| | | | |
|---|---|---|---|
| 2,351,592 | 6/1944 | Barber | 404/84 |
| 2,589,257 | 3/1952 | Horning | 404/84 |
| 2,591,502 | 4/1952 | Bohannan | 404/84 |
| 3,015,258 | 1/1962 | Apez | 404/106 |
| 3,396,644 | 8/1968 | Banks | 404/108 X |
| 3,453,939 | 7/1969 | Pollitz | 404/84 |
| 3,537,363 | 11/1970 | Long | 404/108 |
| 3,572,227 | 3/1971 | Poulsen | 404/108 |
| 3,636,832 | 1/1972 | Schrimper | 404/84 |
| 3,678,817 | 7/1972 | Martenson | 404/84 |
| 3,700,288 | 10/1972 | Davin | 305/38 |
| 3,774,401 | 11/1973 | Allen | 60/420 |
| 3,967,912 | 7/1976 | Parker | 404/84 |
| R25,275 | 10/1962 | Pollitz | 404/84 |

*Primary Examiner*—Nile C. Byers, Jr.
*Attorney, Agent, or Firm*—Graybeal, Barnard & Uhlir

[57] ABSTRACT

Two feed conveyors and two spreader augers are independently driven, each by its own drive motor. The control means for each feed conveyor includes a sensor at the discharge end of the feed conveyor and means responsive to changes in the level of the paving material at the sensor for proportionally increasing the drive speed of the conveyor as the level drops and proportionally decreasing the drive speed of the conveyor as the level rises. The control means for each auger includes a sensor adjacent the discharge end of the auger and means responsive to changes in the level of the paving material at the sensor for proportionally increasing the drive speed of the auger as the level drops and proportionally decreasing the drive speed of the auger as the level rises. The paving material compartment, which includes the feed conveyors and spreader augers, is enclosed. Fumes are pumped out from the enclosed feed path and into a pollution control device.

5 Claims, 18 Drawing Figures

24
20
42
M3
H
M4
44
22
3
3
53
38
51
50
52
54
53
54
40
M1
46
48
M2
26
28
32
35
56
34
LC
LC
12
14
10
4
4

M
36
24
30
H
M4
50
22
M1
52
54
32
56
16
18
14
PH
LC
10

PAVING MACHINE WITH ENCLOSED MATERIAL COMPARTMENT

CROSS-REFERENCE TO RELATED APPLICATION

This is a continuation-in-part of my prior copending application Ser. No. 452,056, filed Mar. 18, 1974, now Pat. No. 3,967,912 and entitled Paver Feed Control.

BACKGROUND OF THE INVENTION

1. Field of the Invention

This invention relates to paving machines, and in particular to the provision of a completely automated paving machine capable of high speed paving over almost any type or condition of subgrade, including when variations in widths are encountered, and which includes an enclosed paving material compartment and pollution control equipment.

2. Description of the Prior Art

The type of paving machine to which this invention relates is generally characterized by a frame which is supported on and is moved forwardly by ground engaging wheels or tracks. The frame supports a hopper into which the paving material is dumped. The paving material is removed from the hopper and moved rearwardly by a pair of endless belt type feed conveyors, one on each side of the machine. The feed conveyors deposit the paving material into a transverse trough containing a pair of laterally extending spreader screws or augers. These augers spread the material out forwardly of a finishing screed which trails the augers. The finishing screed functions to screed and level the paving material.

Finishing machines of the type described are disclosed by the following U.S. Pat. Nos. 2,351,592, granted June 20, 1944 to Harry H. Barber; U.S. Pat. No. 2,589,256, granted Mar. 18, 1952, to Harold R. Horning; U.S. Pat. No. Re. 25,275, granted Oct. 30, 1962 to Harold C. Pollitz; U.S. Pat. No. 3,453,939, granted July 8, 1969 to Harold C. Pollitz, Vernon L. Schrimper and Louis F. Fairchild; 3,537,363, granted Nov. 3, 1970, to George E. Long and Howard G. Anson; 3,678,817, granted July 25, 1972, to Earl D. Martenson and James J. Gebhardt, Jr.; 3,700,288, granted Oct. 24, 1972, to Donald R. Davin and Gary H. Beckley.

Paving machines of the type described which are known to be in use have feed conveyors and spreader augers which are mechanically coupled together and driven by single drive motors. They include a strike-off gate which is vertically movable and is raised or lowered for the purpose of varying the depth of the material which is deposited on the feed conveyors, to in this manner vary the quantity of material which is delivered from the hopper to the region forwardly of the screed.

Several of the aforementioned patents teach varying the feed rate by varying the drive speed of the feed conveyors and spreader augers. Some of such patents teach driving each feed conveyor and its spreader auger independently of the other feed conveyor and its spreader auger. Pollitz et al U.S. Pat. No. 3,453,939 proposes the use of manually controllable means for varying the speed of each feed conveyor and each spreader auger. Each feed conveyor and each spreader auger has its own hydraulic drive motor. The drive motors are independently controllable so that the drive speed of each feed conveyor can be varied relative to the drive speed of its spreader auger.

Pollitz, U.S. Pat. No. Re. 25,275; Pollitz et al U.S. Pat. No. 3,453,939; Long U.S. Pat. No. 3,537,363 and Martenson et al U.S. Pat. No. 3,678,817 disclose control systems for the feed conveyors and the spreader augers which include material level sensing units positioned at the sides of the machine, adjacent the outer ends of the augers. In the machines disclosed by Pollitz U.S. Pat. No. Re. 25,275 and Pollitz et al U.S. Pat. No. 3,453,939, the sensors are in the nature of limit switches which sense only the presence of excess material and function to interrupt operation of the feed conveyor and the spreader screw on the side of the machine to which an excess of material has been delivered. Long U.S. Pat. No. 3,537,363 and Martenson et al U.S. Pat. No. 3,678,817 disclose automatic control systems for varying the drive speed of each feed conveyor and its spreader screw in response to changes in the depth of material sensed at the outboard end of a spreader screw.

All of the known paving machines require that the material compartment in which the feed equipment is located be open at the top so that the operator can look down into it and visually observe the presence, absence and/or relative position of the paving material. The exposed spreader augers present a serious hazard to the operator who must constantly be on guard against accidently stepping or falling down into the augers. Also, due to the open top, toxic fumes from the paving material flow freely upwardly to and around the operator. The fumes not breathed by him (in concentrated doses) flow into and pollute the atmosphere.

SUMMARY OF THE INVENTION

Paving machines of the present invention include independently driven, automatically controlled feed conveyors in addition to independently driven, automatically controlled spreader screws or augers.

According to the invention, a separate material level sensor is located adjacent the discharge end of each feed conveyor. Each such sensor meansures the level of the paving material below it. Each feed conveyor also includes control means responsive to changes in the level of paving material at the sensor for proportionally increasing the drive speed of the feed conveyor as the level drops and proportionally decreasing the drive speed of such conveyor as the level rises. As in the systems disclosed by Long U.S. Pat. No. 3,537,363 and Martenson et al U.S. Pat. No. 3,678,817 a level sensor is also provided adjacent the outboard end of each spreader auger. However, according to the present invention, the signal generated by each such sensor is used for controlling only the drive speed of the associated spreader auger. Each spreader auger includes means responsive to changes in the level of the paving material at its sensor for proportionally increasing its drive speed as the level drops and proportionally decreasing its drive speed as the level rises.

An advantage of the material feed control system of this invention is that a proper head of paving material is always maintained on the screed regardless of the ground speed of the paver and regardless of variations in depth and/or width requirements of the mat. The feed conveyors automatically adjust to changes in the demand of the augers. The material level on the augers never increases to too high a level and never decreases to too low a level. The augers can speed up or slow down, as necessary, without having a direct effect on the quantity of paving material which is delivered by the feed conveyors to the augers. No adjustment of a control gate is necessary. The human element is essentially completely removed from the material feed portion of the paving operation.

The automatic paver feed control makes it possible to accomplish several things in the paving machine of the present invention that cannot be accomplished in the prior art machines. The automatic paver feed control completely removes the human element in the operation of the material feed process. The operator does not have to watch the level of mix at the ends of the auger or at any other location in the path of travel of the paving material. This feature makes it possible to protect the operator from poisonous fumes, the environment from pollution, and everyone who has a need to go onto the machine from accidental injury by the auger system.

According to the present invention a cover is provided over the auger system, making it impossible for a person to either step or fall down into the auger.

According to another aspect of the invention, the paving material compartment is substantially enclosed, and the paving machine is equipped with a pollution control system into which the fumes and pollutants from the paving material is pumped.

These and other features advantages and objectives of the invention will be evident from the illustrated embodiment which is disclosed by the accompanying drawing and described below.

DESCRIPTION OF THE PREFERRED EMBODIMENT

Figure 1:
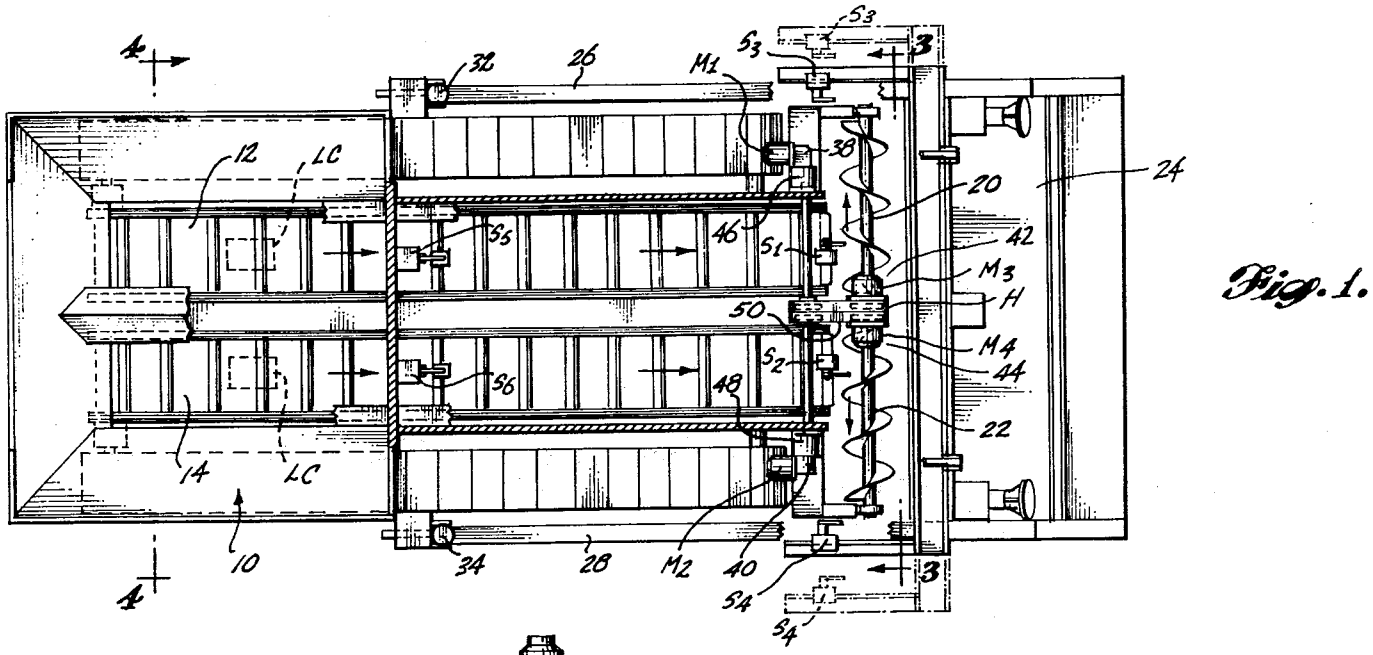
FIG. 1 is a top plan view of a paving machine which incorporates the present invention, such view including broken line showings of screed extenders in their extended positions, with the sensors of the auger drive and control system being mounted on the screed extenders.
Figure 2:
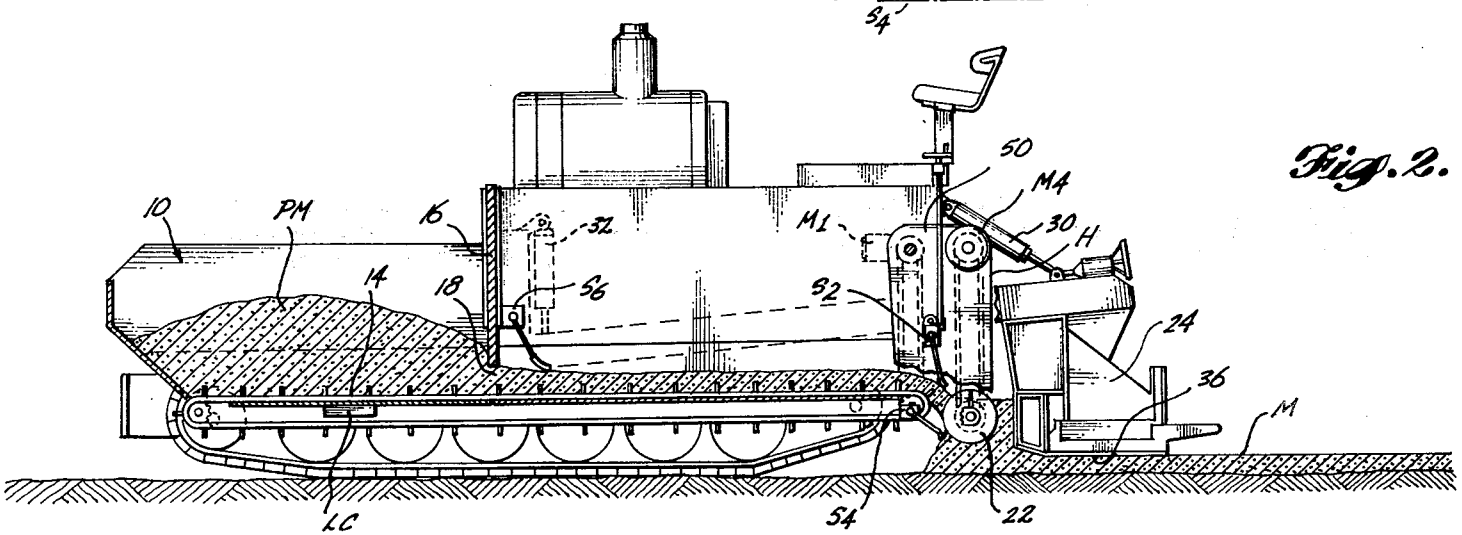
FIG. 2 is a longitudinal sectional view taken through the machine substantially along line 2—2 of FIG. 1.
Figure 3:
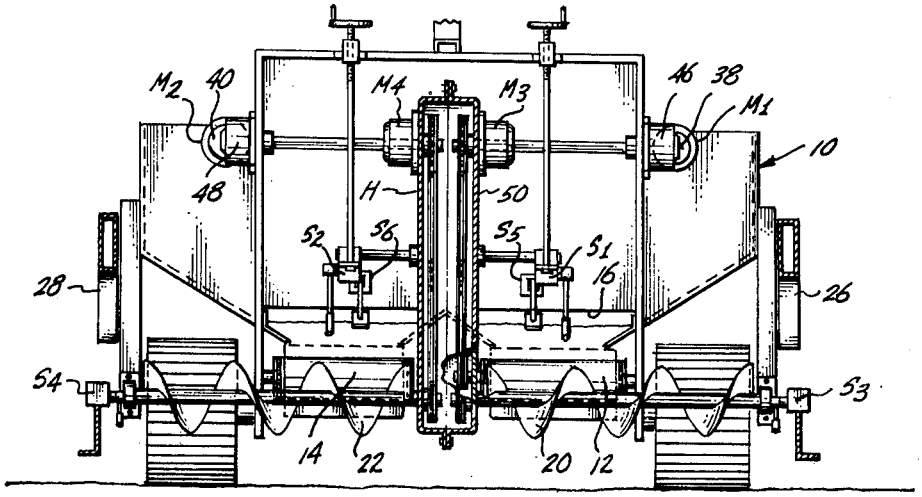
FIG. 3 is a transverse sectional view taken through the auger trough region of the machine, substantially along line 3—3 of FIG. 1.

As shown in FIGS. 1 and 2, asphalt concrete or some other paving material PM is deposited into a hopper 10 located at the forward end of the paving machine. The floor of the hopper 10 is partially defined by the forward portions of the upper flights of a pair of endless belt type feed conveyors 12, 14. A strike-off plate 16 is provided at the downstream end of the hopper 10. The vertical height of the feed opening 18 below plate 16 helps determine the amount of material which leaves the hopper 10 on the feed conveyors 12, 14. The region between the feed opening 18 and the downstream ends of the feed conveyors 12, 14 is usually referred to as the "tunnel".

The feed conveyors 12, 14 deposit the paving material PM into a transverse trough in which a pair of spreader screws or augers 20, 22 are located. A leveling screed 24 trails the augers 20, 22 and works or screeds the paving material PM, to bring the fine materials towards the top, and also to level the material PM and form it into a substantially constant thickness mat M. The screed 24 may be supported by a pair of side arms 26, 28 and cylinders 30 at the rear of the machine. The forward ends of the support arms 26, 28 may be raised and lowered by a pair of hydraulic cylinders 32, 34 which are interconnected between a frame portion of the machine and the forward ends of the arms 26, 28. The cylinders 32, 34, 30 are used for controlling the height and attitude of the lower surface 36 of screed 24 which contacts and works the material PM.

The above described features are all old and well-known in the art and are disclosed by such prior patents as Pollitz et al U.S. Pat. No. 3,453,939 and Davin et al U.S. Pat. No. 3,700,288.

According to an aspect of the present invention, each feed conveyor 12, 14 includes its own variable speed drive means 38, 40 and each auger 20, 22 includes its own drive means 42, 44. Preferably, each drive means 38, 40, 42, 44 includes a hydraulic motor and may also include a transmission. In the illustrated embodiment the drive means 38 includes a hydraulic motor M1, the output shaft of which is coupled to the rear sprocket shaft of feed conveyor 12 by means of a transmission 46. Drive means 40 includes a hydraulic motor M2, the output shaft of which is coupled to the rear sprocket of feed conveyor 14 by means of a transmission 48. Of course, in some installations, the motors M1, M2 may be directly coupled to the sprocket shafts. Motor M1 is automatically controlled by control apparatus which includes a sensor S1. Motor M2 is automatically controlled by control apparatus which includes a sensor S2.

Figure 4:
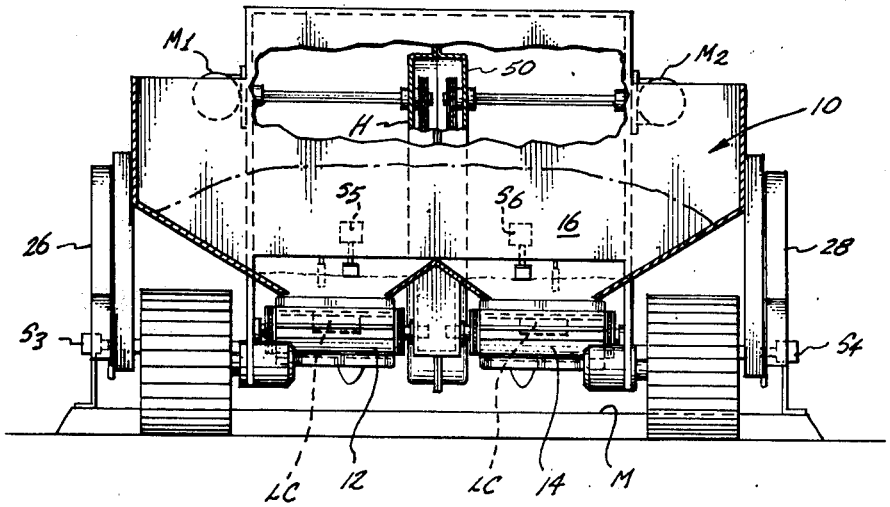
FIG. 4 is a transverse sectional view taken through the hopper, substantially along line 4—4 of FIG. 1.

In the illustrated embodiment, the drive means 42 includes a hydraulic motor M3 which is mounted at the upper end of a chain housing 50. It drives an upper sprocket (FIG. 4) in housing 50 which is connected by a drive chain to a lower sprocket which is secured to the auger 20. In similar fashion, the drive means 44 includes a second hydraulic motor M4 which is connected to the opposite side of the upper part of chain housing 50. It drives an upper drive sprocket which is connected by a drive chain to a lower drive sprocket which is connected to the auger 22. Motor M3 is automatically controlled by control apparatus which includes a sensor S3. Motor M4 is automatically controlled by control apparatus which includes a sensor S4.

Figure 11:
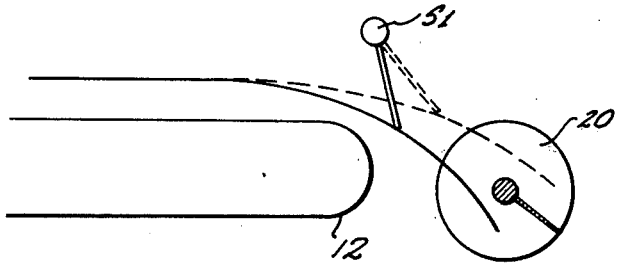
FIG. 11 is a fragmentary side elevational view at the rear end of the left side feed conveyor, showing that the sensor associated with such feed conveyor measures differences in the level of the paving material in a repose region.

The sensors S1, S2 are mounted adjacent the discharge ends of the feed conveyors 12, 14. As best shown by FIG. 11, they detect the level of paving material PM being delivered into the augers 20, 22. Sensors S3, S4 measure the level of the paving material that is delivered to the outer portions of the material trough, i.e. the material maintained forwardly of the screed 24.

According to the present invention, the feed conveyors 12, 14 and the augers 20, 22 are all independently automatically controlled so that a proper amount of paving material is maintained in the trough forwardly of the screed 24 regardless of the surface condition encountered. The control of each of the conveying means 12, 14, 20, 22 is entirely automatic, making it unnecessary for the operator to watch the feed process and then adjust some operation of the machine in response to changes which he sees occur. As a result, it has been found that it has been possible to move the machine forwardly at a faster rate than was possible with a machine lacking such automation.

Figure 10:
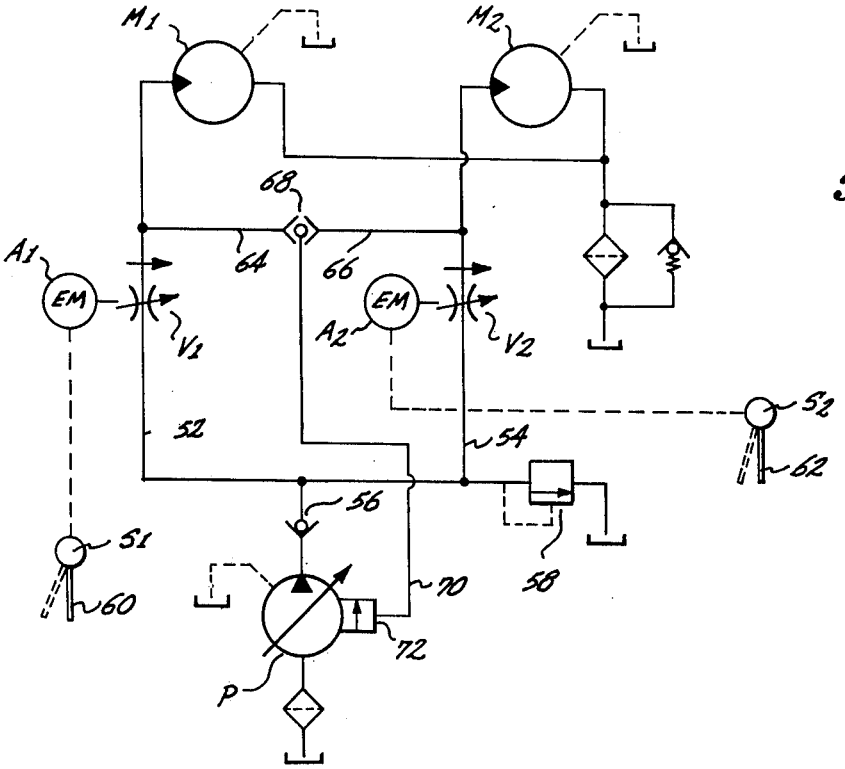
FIG. 10 is a schematic view of the drive and control system for the feed conveyor motors, but also being representative of the drive and control system for the two spreader augers which is essentially identical thereto.

FIG. 10 is a schematic diagram of a preferred embodiment of the drive and control system for the feed conveyors 12, 14. In the preferred embodiment the drive and control system for the augers 20, 22 is essentially identical, so it is not separately shown nor described.

As shown by FIG. 10, a single load sensing pressure compensated piston pump P is used for supplying hydraulic drive fluid through lines 52 and 54 to both feed conveyor drive motors M1, M2. The system is provided with a check valve 56 and a pressure relief valve 58.

The motors M1, M2 may be either high speed, low torque axial piston motors or slow speed, high torque radial piston motors. A speed reduction transmission must be used with the high speed, low torque motors, whereas the low speed, high torque motors may be driven directly coupled to the rear sprocket shafts of the feed conveyors 12, 14.

Motors M1, M2 are flow controlled motors, i.e. the drive speed varies in proportion to the flow rate of the hydraulic fluid which is delivered to them. According to an aspect of the invention, the flow to each motor M1, M2 is independently controlled by a pressure compensated, quick adjustable flow control valve. One such valve V1 is located in the delivery line 52 leading from the pump P to the motor M1 and another such valve V2 is located in the delivery line 54 leading from the pump P to the motor M2. An electric servo motor actuator A1 is associated with valve V1 and another such actuator A2 is associated with valve V2.

Each sensor S1, S2 has a depending control arm 60, 62 which is supported to be in the flow path of the paving material PM. Angular movement of an arm 60, (or 62) adjusts the sensors S1 (or S2) and this generates an electrical signal which causes the actuator A1 (or A2) to rotate the control shafts of the valve V1 (or V2) an amount proportional to the degree of movement of the arm 60 (or 62).

The pump P may be a load sensing pressure compensated piston pump, such as the Delavan model PV 325 OR-32004-5, for example. This particular pump is rated at 23.5 gpm, 1800 RPM and has a 3000 psi maximum continuous pressure rating. Some of the fluid downstream of each valve V1, V2 is tapped and by way of lines 64, 66 is brought to a shuttle valve 68 (e.g. a Fluid Power Systems Model 22-1A shuttle valve). The shuttle valve 68 allows the higher of the two metered flow pressures to be delivered by line 70 back to the controller port 72 of pump P.

The flow control valves V1, V2 may each be a Parker Hannifin Manatrol Division, Model PCQ-800-S valve, modified to accept an electric motor actuator. This type of valve has a built-in pressure regulator so that at any given flow setting the flow through the valve will be constant regardless of variations in the pressure drop across the valve.

The sensors S1, S2 may be steering sensors which have been provided with sensor wands or arms 60, 62 which extend radially from the input shaft of the sensor. For example, the steering sensors may be of the type manufactured by Grad-Line, Inc., under U.S. Pat. No. 3,537,363, and marketed under No. PT 6520-023-001. The electric actuators A1, A2 for the valves V1, V2 may be actuators of the type made by Grad-Line, Inc., and marketed under No. A420, PT NO6522-087-001 (also known as the Grad-Line 180° Electric Servo-motor Actuator).

As previously mentioned, in the preferred embodiment a second pump P of the type described is used for driving the motors M3, M4. Such motors are basically like motors M1, M2 and are controlled by valves like valves V1, V2. Such valves are controlled by actuators like actuators A1, A2 which receive signals from the sensors S3, S4. The sensors S3, S4 are essentially like sensors S1, S2.

The operation of the feed apparatus of this invention will now be described. Let it be assumed that the paving machine is being driven forwardly, the two augers 20, 22 are being driven at the same speed for the purpose of spreading the paving material PM which is delivered to them laterally outwardly of the machine across the front end of the screed 24, and the feed conveyors 12, 14 are being driven at a speed sufficient to deliver the proper amount of paving material PM into the auger trough. The height of the opening 18, the width of each feed conveyor 12, 14, and the drive speed of each conveyor 12, 14 determines the feed rate of the material into the auger trough. Since the height of the opening 18 and the width of the feed conveyors 12, 14 are constants, the feed rate of each conveyor 12, 14 can only be changed by changing the drive speed of such feed conveyor. As will be apparent, any change in the delivery rate will be immediately noticed at the discharge end of the feed conveyor 12 (or 14). This is not true in systems wherein the strike-off panel or gate 16 is adjusted vertically for the purpose of changing the flow rate by adjusting the vertical height of the feed opening 18. With any such adjustment it takes time for the new depth of material to reach the discharge end of the feed conveyor, during which time the flow rate remains unchanged.

As a recap, flow from the pump P is metered by the pressure compensated flow control valves V1, V2 which are controlled by the electric servo motors A1, A2 to cause the hydraulic motors to turn at the desired speed. The pressure in the lines between the hydraulic motors M1, M2 and the flow control valves V1, V2 is that which is induced by the resistance to the metered flow. The pressure in the lines between the flow control valves V1, V2 and the pump P will be 150 psi above the higher of the two load induced pressures downstream of the flow control valves V1, V2. This happens as a result of the shuttle valve 68 allowing the higher of the two metered flow pressures to act on the load sensing pump controller. The pump will deliver as much as is necessary to maintain a pressure 150 psi higher than the pressure sensed at the controller port. Therefore, when the two flow control valves V1, V2 are shut off and the pressure downstream of them drops to 0 the pressure at the outlet of the pump is 150 psi and the pump delivery is 0 since there is no demand. When the pressure downstream of one flow control is 1000 psi and 2000 psi in the other, the pressure at the pump outlet will be 2150 psi and the delivery will be the sum of the two metered flows. The very least pressure drop across the flow control valves V1, V2 will be 150 psi, satisfying the required minimum of 100 psi to operate the regulating spool that is in them. The relief valve 58 is used only to limit the maximum pressure of the system to a value compatable with the components used.

The primary benefit of this design is that it is efficient. The pressure drop across the flow control valves V1, V2 is only 150 psi when the induced pressures are the same regardless of what the induced pressure is. Often systems with two or more motors running in parallel from a single variable flow source are inefficient. This is due to the need to cause the outlet pressure of the pump to be set for as high as would be required for a "worst condition". The difference between "worst condition" pressure and the induced pressure, or the pressure drop across the flow regulating valves multiplied by the flow through these valves gives an energy loss value. This can be high when light load conditions cause low induced pressures at the motors.

All four motors could be driven by one pump in my system with only the difference between the highest induced pressure and the others leading to inefficiencies that would be beyond the losses that are inescapable such as motor, pump and line losses and minimum drop losses across the flow controls required for regulation. In systems with priority type bypass regulators operating in series to split controlled flows from a fixed flow rate pump, the 100 psi regulation pressure mentioned above must be multiplied by the number of valves in series. This kind of circuit is often seen as the solution to our kind of application and would be likely to generate considerably more heat and never less.

FIGS. 5 – 9 are schematics of the left side of the machine. In these views the auger 20 is rotated inwardly 90° so as to appear as an extension of the feed conveyor 12.

Figure 5:
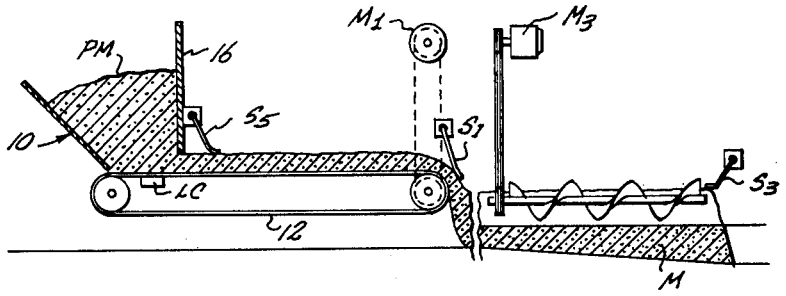
FIGS. 5 – 9 are operational schematic views of the feed and spreader apparatus for the left half of the machine, such views presenting the left side auger rotated 90° from its actual position, so as to appear as an extension of its feed conveyor.

Referring to FIG. 5, let it be assumed that the lower grade (the grade of the ground surface being paved) quickly changes from a flat surface to a crowned surface, i.e. to a surface which slopes downwardly as it extends from the inner end to the outer end of the auger 20. The level of paving material below sensor S3 will immediately drop. When this happens the control arm of sensor S3 moves with the material and generates an electric signal which is proportional to the amount of movement. This electric signal causes a corresponding adjustment in the control valve (not shown by valves V1, V2), to increase the flow of hydraulic fluid to motor M3 so that the motor M3 will rotate faster and drive auger 20 faster. Hence, auger 20 will deliver paving material PM at a faster rate to the outboard end of the auger 20.

The change in the level of the material below sensor S3 almost instanteously changes the drive speed of motor M3.

The faster travel of auger 20 causes a faster movement of paving material PM away from below sensor S1. As a result, the level of material below sensor S1 drops and the sensor arm swings downwardly an amount proportional to the drop in level. This movement of the sensor arms causes the sensor S1 to generate an electric signal which is proportional to the drop in level. This electric signal is transmitted to the actuator A1, causing it to open valve V1 so that additional hydraulic fluid will be delivered to the motor M1. This change in the drive speed of motor M1, and hence the drive speed of feed conveyor 12 and the feed rate of the paving material PM by feed conveyor 12, also occurs almost instanteously.

Thus, very soon after the level of material at the inboard end of the auger 20 drops because the auger 20 is being rotated faster to increase the rate of delivery of paving material PM to the outboard end of auger 20, the feed conveyor 12 starts to run faster so that the paving material PM is delivered to the auger 20 at a faster rate. As previously mentioned, since the feed rate of the paving material PM by the feed conveyor 12 is not dependent on a change in height of the feed opening 18, but rather is dependent only on the drive speed of feed conveyor 12, an increase in the drive speed of conveyor 12 immediately results in an increase in the delivery rate of the paving material PM.

Figure 6:
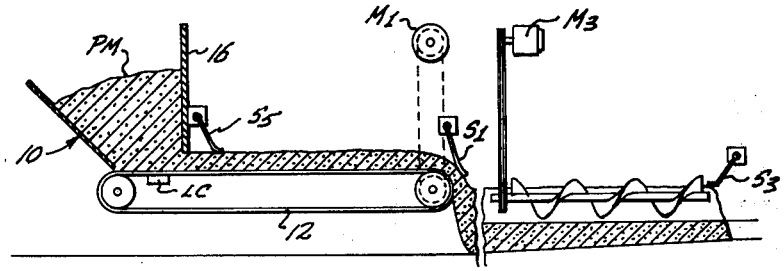

Referring to FIG. 6, let it be assumed that the grade of surface being paved makes an abrupt change under auger 20 so that instead of sloping downwardly from the inboard to the outboard end of the auger it now slopes upwardly. Less material is now needed at the outboard end of auger 20. Hence, the level of material PM under sensor S3 will rise and cause sensor S3 to slow down motor M3. However, sensor S1 will detect a greater demand for material at the inboard end of the auger 20 and will control motor M1 so that it will feed paving material to the inboard end of auger 20 at the rate necessary to meet such greater demand.

Figure 7:
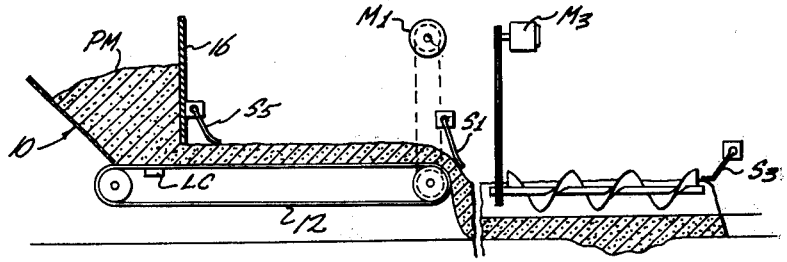
Figure 8:
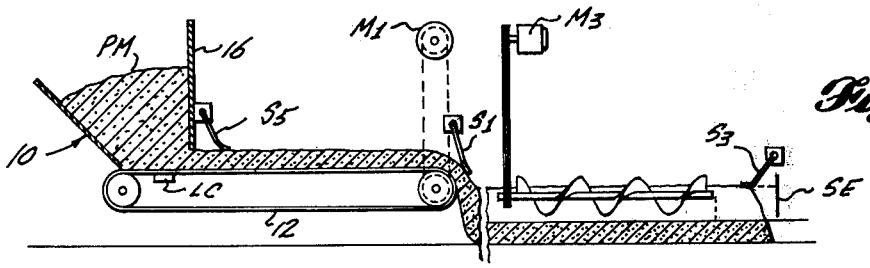

FIG. 7 shows a depression D in the lower grade at a location between the ends of auger 20. This depression will cause the level of material to drop at the inboard end of the auger 20. The drop in level will be sensed by sensor S1, causing it to generate a signal which will speed up motor M1 and increase the feed rate to the inboard end of auger 20 before the depression D can drain a portion of the auger and produce a thin area in the mat.

According to an aspect of the invention, if screed extenders SE are used, the sensors S3, S4 are mounted onto the screed extenders SE so that they will move outwardly when the extenders are moved outwardly. By way of example, screed extenders are disclosed by U.S. Pat. No. 3,109,351, issued on Nov. 5, 1963, to M. J. Dunn, and by U.S. Pat. No. 3,288,041 issued Nov. 29, 1966 to Jack D. Layton. As will be apparent, outward movement of a screed extender SE will cause a decrease in the level of paving material below the sensor S3, causing it to send a signal that will increase the drive speed of motor M3, and hence the delivery rate of auger 20. As in the situation illustrated by FIG. 5, the increased delivery rate of material by the auger 20 will momentarily lower the level at the inboard end of the auger 20, causing movement of sensor S1 and the sending of a signal by it which will increase the drive speed of motor M1 and hence the feed rate of feed conveyor 12.

Figure 9:
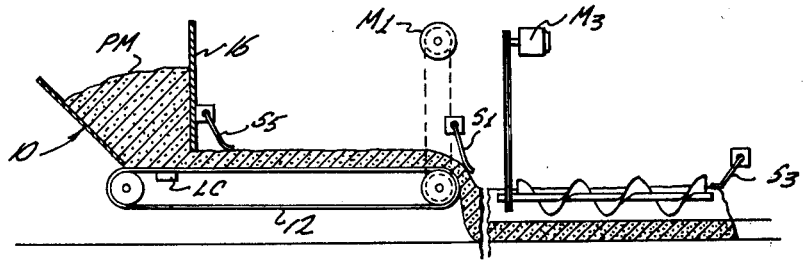

FIG. 9 shows a situation where the lower grade is parallel to the upper grade (i.e. the upper surface of the mat). Under this condition, the drive speed of the motor M1 can be constant and the drive speed of motor M3 can be constant. If this condition were to always exist, the feed conveyor 12 and the auger 20 could be coupled together and drive together, such as is taught by the aforementioned U.S. Pat. Nos. 3,537,363 and 3,678,817. However, this condition does not always exist, so that is why I have provided independent drive means for each feed conveyor 12, 14, independent drive means for each auger 20, 22 and automatic control means which will quickly and automatically vary the drive of each one of these feed components, as necessary, to meet the varying conditions of the surface being paved.

Figure 12:
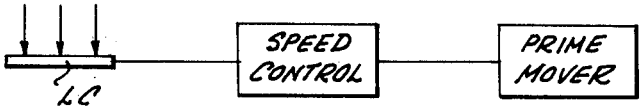
FIG. 12 is a block diagram of a system for slowing down the drive motor in response to the level of paving material in the hopper becoming low.

Another aspect of the invention involves the association of a sensor with each side of the hopper. Preferably, each such sensor is in the form of a load cell LC located below the pan forming the bottom of the hopper 10, over which the upper flights of the feed conveyors 12, 14 ride as they pass through the conveyor 10. The load cells LC measure the rate of the material in each half of the hopper 10. When the amount of material drops below a predetermined level on one side of the hopper, it generates a signal which leads to a speed control (FIG. 12) for the drive system of the vehicle, causing such vehicle to slow down. By way of typical and therefore non-limitive example, the vehicle may be driven by a hydraulic motor of the type described and the sensor LC may control a flow valve of the type described to slow down the motor. When the operator feels the vehicle slowing down he knows that it is time to signal for more paving material PM. The use of some sort of means for measuring the quantity of material in each half of the hopper 10, and then slowing the machine down when the amount of material drops below a predetermined amount, makes it possible for the machine to continue to move forwardly while the operator signals for more paving material PM, and makes it possible for such additional paving material PM to be received and deposited into the hopper 10 before any thinning out of the tunnel occurs.

Figure 13:
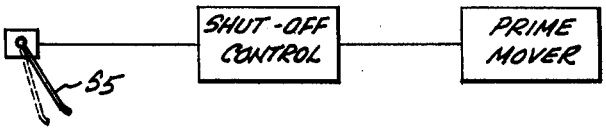
FIG. 13 is a block diagram of a shut-off system for the machine advance mechanism, responsive to a decrease in the level of material in the tunnel region of the machine.

In addition to or in place of the load cell system the paving machine may be provided with a sensor S5, S6 above each feed conveyor 12, 14, immediately downstream of the metering opening 18. Each such sensor may be used for detecting a drop in the depth of material on its feed conveyor 12, 14, indicating a malfunction in the feed process or an emptying of the hopper. A drop in depth sensed by one of the sensor will be used to send a signal to a shut off control (FIG. 13) that will stop forward advancement of the machine.

It may be necessary or desirable to change the height of opening 18 while adapting the machine for a particular job. However, as previously mentioned, while practicing my invention the height of opening 18 is not changed for the purpose of changing the feed rate of the paving material PM.

The independent drive means for the two feed conveyors, the independent drive means for the two auger sections, and the various sensors and control circuitry associated therewith, all of which are shown in FIGS. 1–13, have been omitted from FIGS. 14—18. This was done so that such details would not be present to distract from the details of the enclosed paving material compartment and the pollution control mechanism which is included in FIGS. 14—18. However, it is to be understood that the various mechanisms described below in connection with FIGS. 14–18 exist in a paving machine together with all of the items which are discussed above in connection with FIGS. 1–13 but which have been omitted from FIGS. 14–18.

Referring now to FIGS. 14–18, the paving machine is shown to include a cover 80 for the hopper 10, a cover 82 for the auger region 84, and pollution control apparatus, generally indicated at 86, for collecting the fumes and pollutants which are emitted by the paving material PM. The use of the covers 80, 82 and the pollution control apparatus 86 is only possible because the paving machine includes the invention that is described above in connection with FIGS. 1–13 and is claimed in my aforementioned copending application Ser. No. 452,056.

Figure 14:
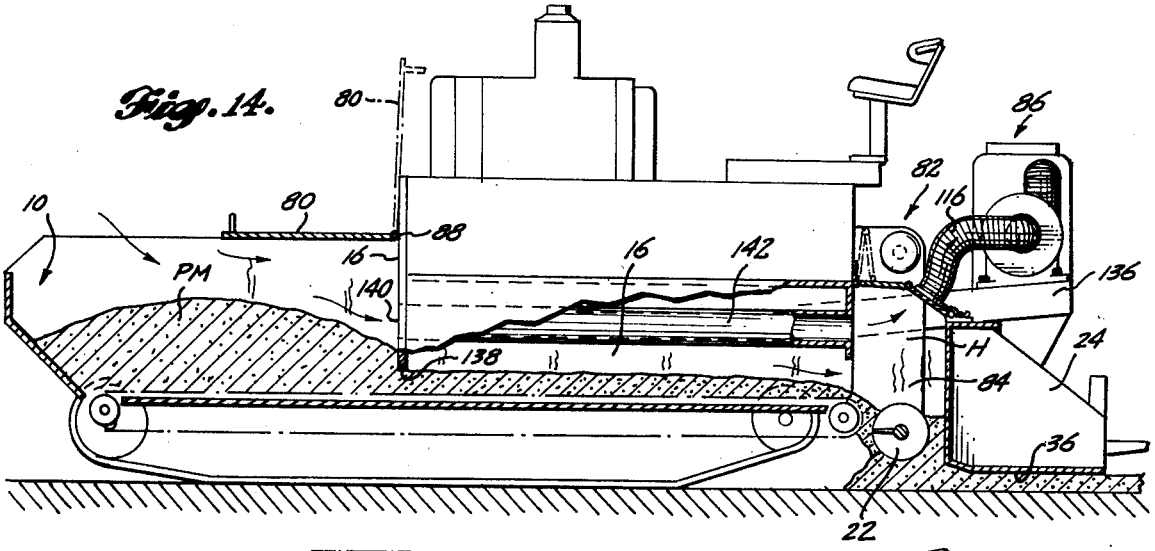
FIG. 14 is a view similar to FIG. 2, of the same paving machine, but showing the paving material compartment being substantially enclosed, including by a cover on the hopper and a cover over the auger, and showing such machine equipped with apparatus for collecting and cleaning the vapors and/or fumes emitted from the asphalt paving material.

The cover 80 for hopper 10 is only diagrammatically illustrated in FIG. 14. It is shown to be pivotally mounted at 88 for pivotal movement about an axis extending transversely of the paving machine, between a "down" position wherein it extends over at least the rearward portion of the hopper 10, and an "up" position, shown by phantom lines in FIG. 14.

In the illustrated embodiment the cover 80 extends across the full width of the top of the hopper 10, but only about ½ of the length. Of course, it is to be understood that in other embodiments a different form of cover may be employed and it may completely cover the top of the hopper except that it is open for the purpose of adding paving material PM to the hopper 10.

In the illustrated embodiment it is contemplated that a dump truck (not shown) containing paving material PM will back up to the hopper and dump material into the hopper through the opening that is left forwardly of the cover 80. It is a common practice to elevate the box of a dump truck into a "dumping" position, with the tail gate open and the lower rear portion of the box over and/or partially within the open top of the hopper 10. Then, the dump truck and the paving machine are moved forwardly together. The opening which remains forwardly of cover 80 is sized to permit this practice. The box of the dump truck then serves to at least partially cover the top opening forwardly of cover 80.

In another installation it is contemplated that the cover 80 may be replaced by a large dimensioned fabric cover which is sized to drape over the entire top opening of hopper 10. Such a cover is either weighed at its periphery, so that the weights will hold it in place, or is provided with a suitable system of fasteners or the like. In such an embodiment the cover is rolled back a sufficient amount to permit dumping of paving material PM into the hopper 10.

The cover 82 for the auger region 84 may be constructed from a plurality of sections. A stationary section 90 may be connected to the housing H. The regions immediately over the augers 20, 22 may be covered by foldable covers 92, 94. In the illustrated embodiment the foldable covers 92, 94 are hinged along their forward edges 96, 98 to a frame portion of the vehicle. They are divided into two parts (92 into parts 100, 102 and 94 into parts 104, 106) and such parts are hinged together (parts 100, 102 by a hinge 108 and parts 104, 106 by a hinge 110).

Figure 17:
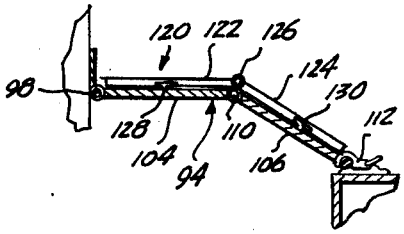
FIG. 17 is a fragmentary sectional view taken through the cover which extends over the auger, substantially along line 17—17 of FIG. 15.

Suitable fasteners, such as designated 112 in FIG. 17, may be provided for securing the rearward edges of the covers 92, 94 to an upper portion of the screed frame.

Figure 16:
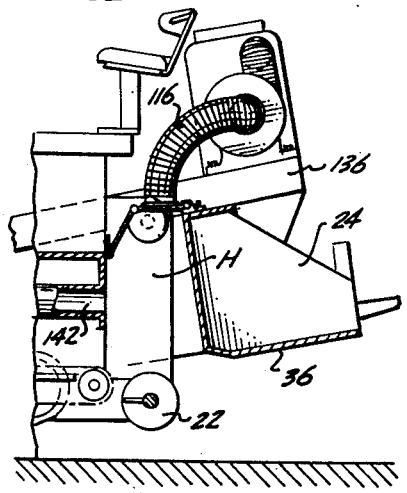
FIG. 16 is a fragmentary elevation view of the screed end portion of the machine as it appears in FIG. 14, but with the screed elevated in position, showing how the cover maybe adapted to permit such movement.

As will hereinafter be discussed in greater detail, hose portions 114, 116 of the pollution control apparatus 86 may be detachably connected to the cover sections 92, 94 about openings provided therein. A comparison of FIGS. 14 and 16 will show that the bifurcated cover sections 92, 94 will accommodate vertical movement of the screed 24. This includes small amounts of movement for the purpose of changing the depth of the pavement and elevation of the screed 24 to a transport position (FIG. 16). Whenever it becomes necessary to gain access to the auger compartment 84, the fasteners 112 are released, the hoses 114, 116 are disconnected, and the covers 92, 94 are swung upwardly into the broken line position shown in FIG. 14.

Figure 15:
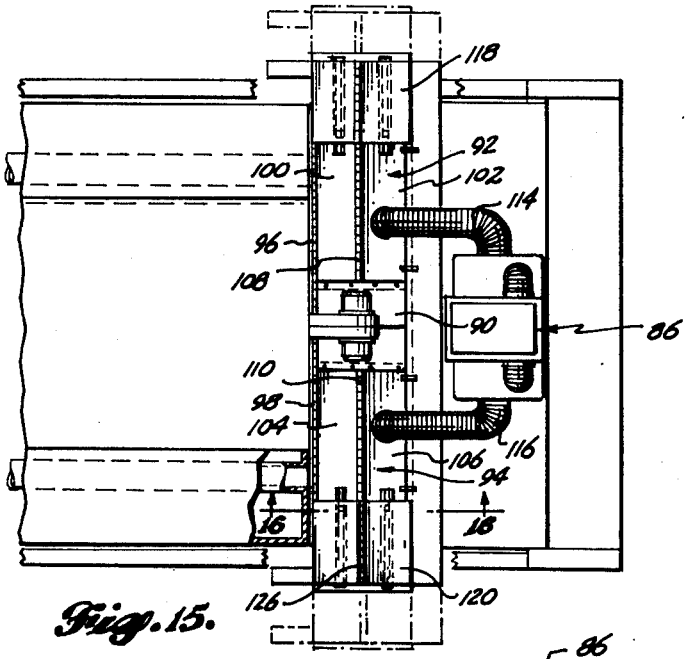
FIG. 15 is a fragmentary top plan view of the covered screed end portion of the paving machine, including phantom line showings of the screed extenders in their extended positions, and cover sections adapted to move in and out with the screed extenders.
Figure 18:
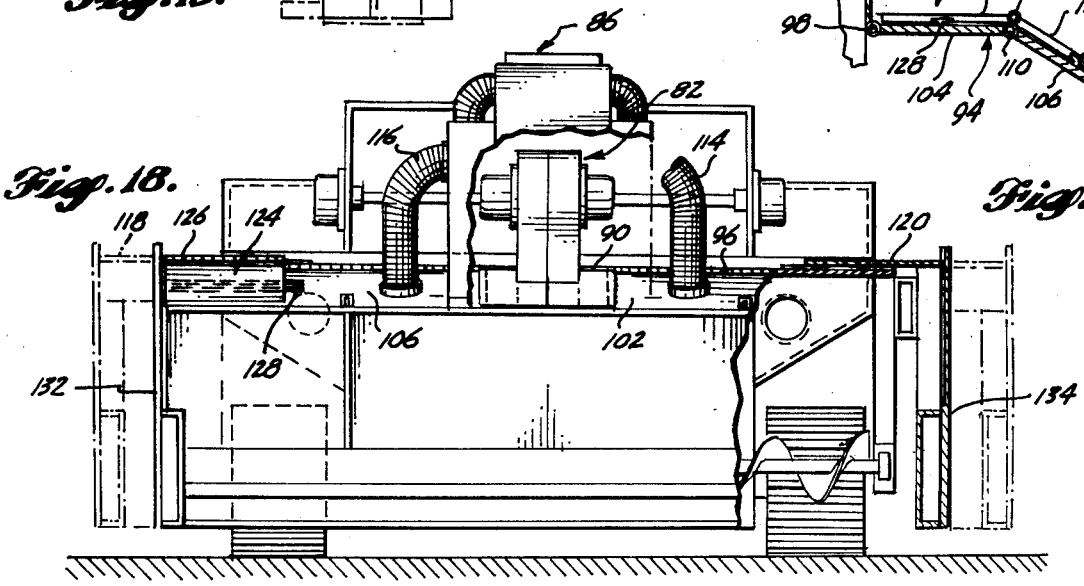
FIG. 18 is a screed end elevational view of the machine, with some parts being cut away for clarity of illustration of other parts, said view including phantom line showings of the screed extenders, and the cover sections carried thereby, in their extended positions.

In a machine equipped with screed extenders the cover sections 92, 94 may themselves be equipped with extensions 118, 120. As shown by FIGS. 15, 17 and 18, the extensions (extension 120 being shown by way of example in FIG. 17) may comprise two parts 122, 124 hinged together at 126, by a hinge which extends parallel to, and is immediately above, hinge 110. Guide rails 128, 130 may be provided on the cover parts 104, 106, to extend longitudinally thereof. Complementary slideways may be provided on the cover parts 122, 124 to engage the rails 128, 30 and guide movement of the extensions 118, 120 longitudinally of the cover parts 92, 94. The ends 126 may be appropriately designed so that the extensions 118, 120 will move together with the cover parts 100, 102 and 104, 106 during raising and lowering of the screed 24. As shown by FIG. 17, the extension parts 122, 124 may be slightly narrower than the cover parts 100, 102 and 104, 106, and be free of connection with anything at their front and rear edges.

As shown by FIG. 18, the screed extenders may include vertical outside side walls 132, 134. The side walls 132, 134 may be extended upwardly above the cover extensions 118, 120, so that the outer ends of the extension parts 122, 124 can abut up against the inner surface of the walls 132, 134. By this arrangement the screed 24 may be adjusted vertically in position relative to the rest of the vehicle and the cover extensions 118, 120 may move without an opening being provided endwise of cover extensions 118, 120.

Of course, it is to be recognized that suitable sealing material may be provided between the edges of the various cover parts and the adjoining structure, so as to obtain a better seal against gas leakage around the various cover parts.

As best shown by FIG. 15, the various cover parts 90, 92, 94, 118, 120 extend completely over the augers 20, 22, so that it is possible for a person to either accidentally step down into, or fall into, the auger compartment 84 and become injured by the augers 20, 22.

The illustrated embodiment shows a pollution control mechanism 18 mounted on the transverse portion 136 of the screed frame. The aforementioned hoses 114, 116 may be made from an accordian type material, so that they will accommodate relative movement of the cover parts 102, 106.

As shown by FIG. 14, an opening 40 may be provided in wall 16, at a distance above the strike-off or gauge edge 138, to provide a passageway for fumes from within the hopper 10 to the region rearwardly of wall 16. A conduit 142 may be provided for directly ducting the fumes from such opening 140 rearwardly to the auger compartment 84. Or, the opening 140 may merely communicate the hopper side of wall 16 with the opposite side thereof.

The pollution control mechansim includes a pump or fan which is arranged to draw the fumes and other pollutants from within the hopper 10, from within the paving material conveyor space rearwardly of wall 16, and from within the auger compartment 84, into a collection chamber which includes known apparatus and substances for substantially cleansing the air before it is discharged out into the atmosphere. It is believed that even though in the illustrated embodiment some opening to the atmosphere will exist forwardly of cover 80, the pump will cause at least most of the pollutants from within the hopper 10 to flow rearwardly to the pollution control apparatus 86 rather than forwardly and upwardly into the atmosphere.

The central region of the machine above the two conveyor flights 12, 14 is covered by an upper wall portion of the vehicle frame. The hopper 10 is covered either by a short cover 80, used alone, or in combination with a rear portion of a dump truck, or a larger cover as described above. The inclusion into the paving machine of the completely automatic control system for the conveyor flights 12, 14 and the auger sections 20, 22 are what makes it possible to provide a cover over the auger section 84. Such cover over the auger sections 84 prevents accidental injury by way of a person either stepping into or falling into the augers 20, 22. Such cover for the auger section, and the other above described covers, and the side and bottom portions of the material conveying compartment, provide an enclosure for the paving material PM which serves to hold in the fumes and other pollutants, and the pollution control apparatus 86 functions to collect and to a considerable extent purify the air in which such pollutants are carried.

What is claimed is:

1. In a paving machine comprising a pair of endless feed conveyors arranged to deliver paving material rearwardly from a hopper to the inboard ends of a pair of transverse augers which spread the material outwardly and deposit it onto the surface being paved forwardly of a leveling screed which trails the augers, the improvement comprising:

a fixed height opening at the hopper to control the amount of paving material that is delivered from the hopper onto each feed conveyor;

a separate variable speed drive means for each feed conveyor; each of which is operatively connected to its feed conveyor;

control means for the feed conveyor drive means, including a separate sensor for each feed conveyor, each of which is mounted on the paving machine adjacent the discharge end of its feed conveyor and at the inboard end of the associated auger, for measuring changes in the level of the paving material deposited onto the surface below the sensor and producing a signal proportional to said changes, and means operatively connected to said sensor which is responsive to the signal indicating changes in the level of the paving material at the sensor, for proportionally and substantially instantaneously increasing the drive speed of the associated feed conveyor as the level drops and proportionally and substantially instantaneously decreasing the drive speed of such feed conveyor as the level rises;

a separate variable speed drive means for each auger, each of which is operatively connected to its feed conveyor;

control means for the auger drive means, including a separate sensor for each auger, each of which is mounted on the paving machine adjacent the outboard end of its auger for measuring changes in the level of the paving material deposited onto the surface below the sensor and producing a signal proportional to said changes, and means operatively connected to said sensor which is responsive to the signal indicating changes in the level of the paving material at the sensor, for proportionally and substantially instantaneously increasing the drive speed of the associated auger as the level drops and proportionally and substantially instantaneously decreasing the drive speed of such auger as the level rises, whereby the feed conveyors and the augers are continuously being independently and automatically driven at speeds proportional to the demand for paving material at the discharge ends thereof; and cover means extending over the transverse augers to form a barrier for preventing a person on the paving machine from stepping or falling downwardly into the auger.

2. A paving machine according to claim 1, wherein said cover means extends between a frame portion of the paving machine located forwardly of the augers and a leveling screed which trails the augers, and wherein said cover means will permit vertical movement of the leveling screed relative to said frame portion of the paving machine.

3. A paving machine according to claim 1, further comprising a screed extender mounted on at least one side of said paving machine; means on said paving machine operatively connected to said screed extender, for extending and retracting it; and wherein said cover means includes an extendible-retractible portion which is adapted to be extended and retracted together with the screed extender.

4. In a paving machine comprising a pair of endless feed conveyors arranged to deliver paving material rearwardly from a hopper to the inboard ends of a pair of transverse augers which spread the material outwardly and deposit it onto the surface being paved forwardly of a leveling screed which trails the augers, the improvement comprising:

a fixed height opening at the hopper to control the amount of paving material that is delivered from the hopper onto each feed conveyor;

a separate variable speed drive means for each feed conveyor, each of which is operatively connected to its feed conveyor;

control means for the feed conveyor drive means, including a separate sensor for each feed conveyor, each of which is mounted on the paving machine adjacent the discharge end of its feed conveyor and at the inboard end of the associated auger, for measuring changes in the level of the paving material deposited onto the surface below the sensor and producing a signal proportional to said changes, and means operatively connected to said sensor which is responsive to the signal indicating changes in the level of the paving material at the sensor, for proportionally and substantially instantaneously increasing the drive speed of the associated feed conveyor as the level drops and proportionally and substantially instantaneously decreasing the drive speed of such feed conveyor as the level rises;

a separate variable speed drive means for each auger, each of which is operatively connected to its feed conveyor;

control means for the auger drive means, including a separate sensor for each auger, each of which is mounted on the paving machine adjacent the outboard end of its auger for measuring changes in the level of the paving material deposited onto the surface below the sensor and producing a signal proportional to said changes, and means operatively connected to said sensor which is responsive to the signal indicating changes in the level of the paving material at the sensor, for proportionally and substantially instantaneously increasing the drive speed of the associated auger as the level drops and proportionally and substantially instantaneously decreasing the drive speed of such auger as the level rises, whereby the feed conveyors and the augers are continuously being independently and automatically driven at speed proportional to the demand for paving material at the discharge ends thereof;

wall means enclosing at least a substantial portion of the hopper, feed conveyor and augers; and pollution control means on said machine for collecting pollutants from the enclosed regions.

5. A paving machine according to claim 4, wherein said pollution control means includes pump means for pumping pollutants out from the enclosed regions.

* * * * *